US011207729B2

(12) United States Patent
Xu et al.

(10) Patent No.: US 11,207,729 B2
(45) Date of Patent: Dec. 28, 2021

(54) LIGHT REDUCTION METHOD FOR CONTINUOUS CASTING OF BLOOM PLAIN-BARRELLED ROLL-ROLLER COMBINATION

(71) Applicant: BAOSHAN IRON & STEEL CO., LTD., Shanghai (CN)

(72) Inventors: Rongjun Xu, Shanghai (CN); Junjiang Liu, Shanghai (CN); Genjie Wan, Shanghai (CN); Chengbin Li, Shanghai (CN); Xiangchun Liu, Shanghai (CN); Qingyu Meng, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 17/271,041

(22) PCT Filed: Aug. 16, 2019

(86) PCT No.: PCT/CN2019/101037

§ 371 (c)(1),
(2) Date: Feb. 24, 2021

(87) PCT Pub. No.: WO2020/042924

PCT Pub. Date: Mar. 5, 2020

(65) Prior Publication Data

US 2021/0323052 A1 Oct. 21, 2021

(30) Foreign Application Priority Data

Aug. 31, 2018 (CN) ..... 201811014372.4

(51) Int. Cl.

| | |
|---|---|
| ***B22D 11/20*** | (2006.01) |
| ***B22D 11/12*** | (2006.01) |
| ***B22D 11/128*** | (2006.01) |

(52) U.S. Cl.

CPC ..... *B22D 11/202* (2013.01); *B22D 11/1206* (2013.01); *B22D 11/1287* (2013.01); *B22D 11/207* (2013.01)

(58) Field of Classification Search

CPC ..... B22D 11/202; B22D 11/1206; B22D 11/1287; B22D 11/207; B22D 11/20

See application file for complete search history.

(56) References Cited

U.S. PATENT DOCUMENTS 5,634,513 A 6/1997 Ishiguro et al.

FOREIGN PATENT DOCUMENTS

CN 101890488 A 11/2010
CN 105983668 A 10/2016

(Continued)

OTHER PUBLICATIONS

International Search Report dated Nov. 15, 2019 for PCT Patent Application No. PCT/CN2019/101037.

(Continued)

*Primary Examiner* — Kevin P Kerns
*Assistant Examiner* — Steven S Ha
(74) *Attorney, Agent, or Firm* — Lei Fang; Smith Tempel Blaha LLC

(57) ABSTRACT

Disclosed is a light reduction method for continuous casting of a bloom plain-barrelled roll-roll combination. The method comprises: firstly obtaining three-dimensional temperature field profile, a two-phase region, solid-phase region thickness, and solid-phase fraction of a billet, determining positions of start and end rolls of the reduction, and setting a reduction amount of each tensioner roll according to the volume shrinkage of the billet; in an interval $f_s$=0.9-1.0 of the solid-phase fraction of the billet, performing a heavy (Continued)

reduction working mode; and in an interval $f_s$=0.25-0.80 of the solid-phase fraction of the billet, performing a light reduction working mode.

13 Claims, 4 Drawing Sheets

(56) References Cited

FOREIGN PATENT DOCUMENTS

| | | | |
|---|---|---|---|
| CN | 106001475 | A | 10/2016 |
| CN | 205834144 | U | 12/2016 |
| CN | 106513612 | A | 3/2017 |
| CN | 107377919 | A | 11/2017 |
| JP | 2004058129 | A | 2/2004 |

OTHER PUBLICATIONS

Written Opinion dated Nov. 15, 2019 for PCT Patent Application No. PCT/CN2019/101037.
Supplementary European Search Report dated Aug. 16, 2021 for EP 19853592.4-1103/3845330.

LIGHT REDUCTION METHOD FOR CONTINUOUS CASTING OF BLOOM PLAIN-BARRELLED ROLL-ROLLER COMBINATION

CROSS-REFERENCE TO RELATED APPLICATIONS

This application is a 371 U.S. National Phase of PCT International Application No. PCT/CN2019/101037 filed on Aug. 16, 2019, which claims benefit and priority to Chinese patent application no. CN 201811014372.4 filed on Aug. 31, 2018, the contents of both are incorporated by reference herein in their entries.

TECHNICAL FIELD

The present disclosure pertains to the field of metal casting, and particularly relates to a method for in-situ post-treatment or post-processing of a cast slab.

BACKGROUND ART

During continuous casting of steel, the surface of a casting slab solidifies earlier than the inside of the casting slab due to external cooling. As a result, the surface shrinks more than the inside. As the solidification and crystallization end, columnar crystals on both sides of some local areas are bridged. When liquid confined under the bridge solidifies, replenishment of molten steel from above the bridge to liquid phase cavity is blocked. Then, shrinkage cavity and porosity are generated when the molten steel under the bridge solidifies. With the formation of shrinkage cavity and porosity, the vacuum shrinkage cavity may suck solute-rich liquid between dendritic crystals and allow it to flow toward the center. At the same time, macro-segregation occurs.

Since soft reduction is equivalent to compression casting, it has the effect of eliminating shrinkage cavity, porosity and macro-segregation at the same time. Hence, the flat-roll soft reduction technology for casting slabs has been widely used in the field of continuous casting.

Because the surface of the casting slab solidifies earlier than the inside, the closer to the solidification end, the thicker the casting slab shell and the lower the temperature. Since both sides of the slab shell have solidified completely, the closer the reduction process is to the solidification end, the greater the deformation resistance. The existing technology employs a pair of flat rolls for compression. Due to the exchangeability of tension levelers, they are all made the same, so the reduction force is also the same. As a result, the pressure applied by an upstream tension leveler is excessive while the pressure applied by a downstream tension leveler is insufficient. As an increasing quantity of high-alloy steel is produced, this problem has become more prominent. To address this problem, there is proposed a technology according to which a convex roll is used to achieve more effective soft reduction of unsolidified parts.

Chinese patent application for invention No. CN 105983668 A published on Oct. 5, 2016 discloses a "soft reduction roll, a soft reduction device comprising the same, and a method for manufacturing a cast slab", wherein the soft reduction roll has a smaller diameter at the end part than in the middle part, wherein when the cross section of the soft reduction roll comprising a rotation axis is observed, the outer periphery between the middle part and the end part has a first arc bulging toward the rotation axis at the end side, and a second arc bulging in a direction opposite to the bulging direction of the first arc at the middle part side, wherein a tangent line tangent to both the first arc and the second arc forms an angle of 40° or less with the rotation axis. This technical solution utilizes a constant-curvature protuberance-free convex roll (drum roll) which is installed at a position having a solid fraction of 0.2 to apply a large reduction, and a convex roll having a protuberance and a gradient curvature is located at the solidification end. Reduction with a large amount of deformation is only utilized sequentially at two positions, namely the center having a solid fraction of 0.2 and the solidification end, in an attempt to overcome the quality defects of segregation of chemical components, and shrinkage cavity and serious porosity in the solidification center. However, according to the solidification principle of a casting slab, soft reduction is equivalent to compression casting, wherein the reduction is used to compensate for the current shrinkage of molten steel and restrict the flow of molten steel rich in low-melting impurities between dendritic crystals to the center. An excessive reduction is not conducive to the alleviation of solidification segregation.

The above-mentioned Chinese patent application for invention further discloses a soft reduction device, wherein the transition curve of the convex roll consists of two sections of arc lines which are tangent to each other, one being inwardly concave and the other being outwardly convex. The radii of the two arcs are not equal. Generally, the first outwardly convex arc has a radius that is smaller than that of the second inwardly concave arc. The purpose is to reduce occurrence of folding defects in a depressed part of the cast slab during a subsequent steel rolling process.

Chinese patent application for invention No. CN 107377919 A published on Nov. 24, 2017 discloses a "method for increasing the center density of a cast slab of bearing steel", wherein the drawing speed of a casting machine is controlled at 0.50 m/min-0.65 m/min during a continuous casting process, and the degree of superheat of the molten steel in the tundish is controlled at 20° C.-30° C. Heavy reduction at the solidification end is adopted. Soft reduction and heavy reduction are performed based on the distribution of the solid fraction. Heavy reduction begins at fs=0.9, and a convex roll is used for the heavy reduction at fs=1.0. Heavy reduction at the solidification end is adopted in this technical solution. A single convex roll is used for the heavy reduction when fs=0.9-1.0 so as to reduce shrinkage cavity. However, the above patent application does not address the issue of how to perform soft reduction.

SUMMARY

The technical problem to be solved by the present disclosure is to provide a soft reduction method for a continuous casting bloom with a combination of a flat roll and a convex roll. In this soft reduction method for a continuous casting bloom with a combination of a flat roll and a convex roll, the convex roll is used to partially reduce the reduction force of a tension leveler and reduce the withdrawal resistance. The convex rolls on different tension levelers include protuberances having different lengths, and the final indentation profile generated on the upper surface of the casting bloom has a wider opening. This can avoid occurrence of folding defects in a subsequent steel rolling process, and it is more conducive to reducing the reduction force, even more conducive to reducing the reduction force of the convex roll tension leveler.

The technical solution of the present disclosure is to provide a soft reduction method for a continuous casting bloom with a combination of a flat roll and a convex roll, comprising sequentially arranging a plurality of tension levelers on a continuous casting line to compression cast the casting bloom, characterized by:

1) acquiring model data of solidification heat transfer and liquid phase cavity in continuous casting of a casting bloom, wherein one way to acquire the model data is to perform model calculation on the solidification heat transfer and liquid phase cavity in the continuous casting of the bloom according to theories of continuous casting and casting molding, wherein a three-dimensional temperature field profile, a two-phase region thickness, a solid-phase region thickness and a solid fraction along a casting direction are calculated from various steel grades, drawing speeds, cooling conditions, and superheat degrees;

2) determining positions of rolls starting and ending reduction based on the model data or model calculation, and associating the model data with each tension leveler on the continuous casting line so that each tension leveler on the continuous casting line corresponds to the associated three-dimensional temperature field profile, two-phase region thickness, solid-phase region thickness and solid fraction of the casting bloom; and 3) acquiring a volume shrinkage of the casting bloom, and setting a reduction for each tension leveler roll based on the volume shrinkage, wherein an embodiment for acquiring the volume shrinkage of the casting bloom includes acquiring it using an empirical formula according to casting conditions.

In step 3), a heavy reduction operation mode is implemented on the casting bloom in a zone of the casting bloom having a solid fraction of $f_s$=0.9 to 1.0. That is, when the solid fraction is $f_s$=0.9-1.0, one or more convex roll tension levelers are used to perform compression casting on the casting bloom, and each tension leveler achieves a reduction with a single-roll reduction rate of 1%-10%. In one embodiment, a maximum single-roll reduction is 10 mm. In addition, in step 3), a soft reduction operation mode is implemented on the casting bloom in a zone of the casting bloom having a solid fraction of $f_s$=0.25 to 0.80, and correspondingly, each tension leveler achieves a reduction with a single-roll reduction rate of no more than 2%. In one embodiment, the reduction is no more than 5 mm.

In one or more embodiments of the soft reduction method, when the solid fraction is $f_s \leq 0.5$, a flat roll tension leveler is used to perform compression casting on the casting bloom; and when the solid fraction is $f_s > 0.5$, a convex roll tension leveler is used to perform compression casting on the casting bloom.

The reduction rate is obtained by dividing the reduction with the thickness of the casting bloom.

According to the aforementioned solution, for an upstream tension leveler far away from the solidification end, a flat roll tension leveler is still used to perform compression casting on the casting bloom.

For a downstream tension leveler closer to the solidification end, a convex roll tension leveler is used to perform compression casting on the casting bloom.

According to the soft reduction method, a combination of a flat roll tension leveler and a convex roll tension leveler is used in the soft reduction method to control the soft reduction of the cast bloom at the solidification end to reduce the center porosity, shrinkage cavity and segregation of the cast bloom, and improve the internal quality of a rolled product.

The soft reduction method can reduce the reduction force of the convex roll tension leveler, and at the same time reduce the withdrawal resistance in the continuous casting process.

In one or more embodiments of the soft reduction method, the upper roll of the convex roll tension leveler is a convex roll which can be raised or lowered to adjust the roll gap, and the convex roll is connected to a motor and a speed reducer. The lower roll of the convex roll tension leveler is a flat roll. The upper roll and the lower roll are connected by a frame, and a reduction force is applied to the casting bloom therebetween through four pairs of driving hydraulic cylinders.

In one or more embodiments of the soft reduction method, the upper roll is a convex roll, and it is a driving roll. The lower roll is a flat roll, and it is a fixed driven roll.

In one or more embodiments of the soft reduction method, the profile curve of the working part of the convex roll body consists of a first straight line section AB, a first transition curve section BC, a second straight line section CD, a second transition curve section DE, and a third straight line section EF connected in sequence, wherein the first straight line section AB and the third straight line section EF are arranged coaxially or coplanarly; the second straight line section CD and the first straight line section AB or the third straight line section EF are arranged in parallel; and the first curve section BC and the second curve section DE are each composed of a sine curve, or composed of two arc lines that are tangent to each other, one inwardly concave, and the other outwardly convex, the radii of the two arcs being equal or unequal. For the cross section in the axial direction of the convex roll, the first transition curve section BC, the second straight line section CD and the second transition curve section DE form a protruding structure in the form of a protuberance on the surface of the convex roll.

With the use of the soft reduction method, the opening of the indentation profile generated on the upper surface of the cast bloom is wider. This can avoid occurrence of folding defects in a subsequent steel rolling process, and it is more conducive to reducing the reduction force, even more conducive to reducing the reduction force of the convex roll tension leveler.

In one or more embodiments of the soft reduction method, the first transition curve section BC of the protuberance is a sine curve represented by the following equation:

$$y=H\sin(x*\pi/2nH);$$

wherein H is a height of the protuberance; n is a projection length of the first transition curve section BC of the protuberance on the axis.

In one or more embodiments of the soft reduction method, the second transition curve DE is mirror-symmetrical to the first transition curve BC, and the mirror-symmetrical centerline is a straight line that passes through the midpoint of the second straight line section CD and is perpendicular to the second straight line section CD.

In one or more embodiments of the soft reduction method, in the zone where the casting bloom has a solid fraction=0.25 to 0.80, for each tension leveler, the opening of the indentation profile generated on the upper surface of the casting bloom is equal to the length of the second straight line section CD of the convex roll body.

In one or more embodiments of the soft reduction method, the length of the second straight line section CD of the convex roll body of each tension leveler depends on the width D of the unsolidified two-phase region of the continuous casting bloom when it arrives at the position of the tension leveler.

In one or more embodiments of the soft reduction method, the length of the second straight line section CD of the convex roll body of each tension leveler is ≥D+40 mm.

Compared with the prior art, the present disclosure includes the following advantages:

1. According to some embodiments, the soft reduction method for a continuous casting bloom with a combination of a flat roll and a convex roll is used to control the soft reduction at the solidification end, and it is used comprehensively to reduce center porosity, shrinkage cavity and segregation of the cast bloom, and improve the internal quality of a rolled material.

2. According to some embodiments, the solidified bloom shells on both sides are prevented from generating large deformation resistance, which can reduce the reduction force of the convex roll tension leveler. As the friction force is reduced, the withdrawal resistance in the continuous bloom casting process is also reduced.

3. According to some embodiments, instead of fulfilling the soft reduction by applying a large reduction amount with a single convex roll, the reduction is dispersed. After the reduction is completed, the reduction rolls with protuberances of different lengths provide a wider opening to the indentation profile generated on the upper surface of the cast bloom at the end. This can avoid occurrence of folding defects in a subsequent steel rolling process, and it is more conducive to reducing the reduction force of the convex roll tension leveler.

DETAILED DESCRIPTION

The present disclosure will be further illustrated with reference to the accompanying drawings and the following Examples.

Figure 1:
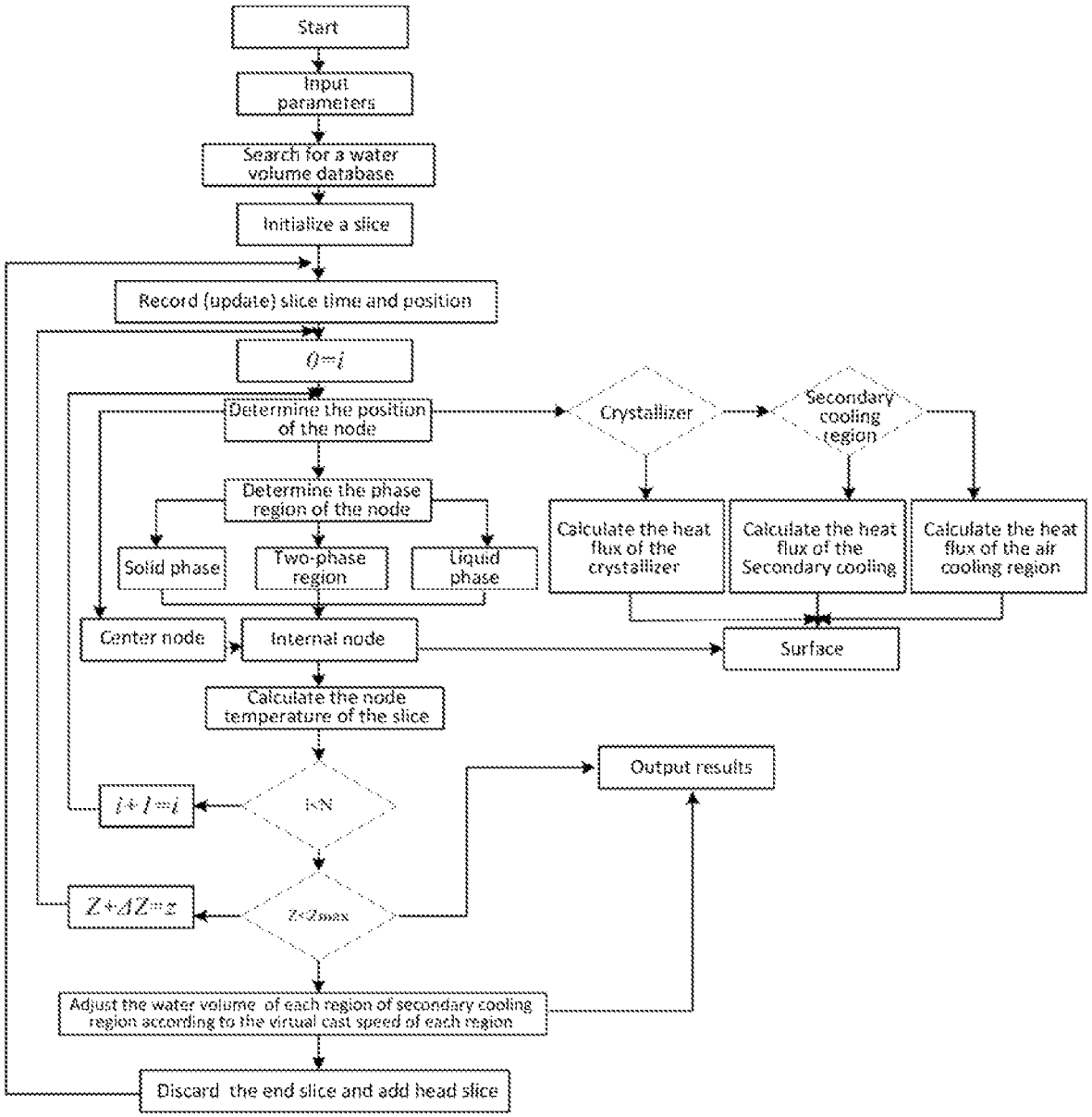
FIG. 1 shows schematically a flow chart for calculating solidification heat transfer in continuous casting according to the present technical solution.

As shown by FIG. 1, first of all, model calculation is performed on the solidification heat transfer and liquid phase cavity in continuous casting of a bloom according to the existing theories of continuous casting and casting molding:

According to the solidification heat transfer equation:

$$\rho C_p \frac{\partial T}{\partial t} = \lambda\left(\frac{\partial^2 T}{\partial x^2} + \frac{\partial^2 T}{\partial y^2} + \frac{\partial^2 T}{\partial z^2}\right) + q_v \tag{1}$$

Setting Initial Conditions:

$$T|_0 = T(x,y,z,0) \tag{2}$$

Boundary Conditions:

First Class Boundary Conditions:

$$T|_w = T_w = T_w(t) \tag{3}$$

Second Class Boundary Conditions:

$$-\lambda \frac{\partial T}{\partial n}\bigg|_w = q_w(t) \tag{4}$$

Third Class Boundary Conditions:

$$-\lambda \frac{\partial T}{\partial n}\bigg|_W = h(T_W - Ta) \tag{5}$$

Inputting the physical parameters of the steel, and using finite element calculation to model the three-dimensional temperature field profile, two-phase region thickness, solid-phase region thickness and solid fraction when the casting bloom arrives at the position of each tension leveler for different steel grades, drawing speeds, cooling conditions, and superheat degrees.

FIG. 1 is a flow chart for calculation of solidification heat transfer in continuous casting. In the flow chart, "start" represents start of calculation; "input parameters" represents input of the physical parameters of the steel, steel grade, drawing speed, superheat degree, etc.; "search for a water volume database" represents searching for the cooling water volume in each cooling loop in each cooling zone; "initialize a slice" represents initialization of a slice at the beginning of the finite element slicing calculation; "record (update) slice time and position" represents recording (updating) the time when the slice is formed and the position at which the slice arrives; "determine the position of the slicing point" represents determining whether the slicing point is in the crystallizer or in the secondary cooling region; if it's in the "crystallizer", calculate the heat flow in the crystallizer; if it's in the "secondary cooling region", calculate the heat flow in each secondary cooling region; if the "secondary cooling region" is not a water cooling zone but an air cooling zone, calculate the heat flow in the air-cooling zone; "determine the phase region of the node" represents determining whether the node is in the "liquid phase region", "two-phase region", or "solid-phase region"; at the same time, "determine the position of the slicing point" determines whether the node is in the "center", "inside" or "surface" of the bloom; "calculate the slice temperature" represents calculation of the temperature value of each slice; "output results" represents outputing the three-dimensional temperature distribution of the casting bloom, the two-phase region thickness, the solid-phase region thickness, solid fraction and other calculation results.

Figure 2:
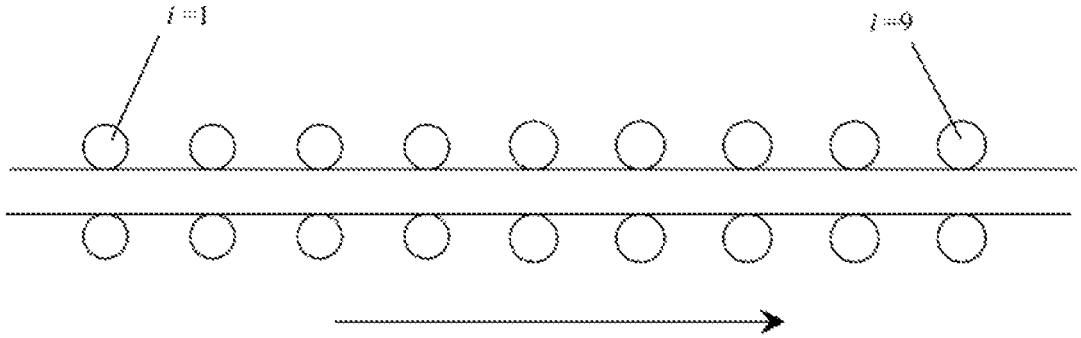
FIG. 2 shows schematically positions for installing soft reduction tension levelers along a bloom according to the present disclosure.

FIG. 2 shows the location or position of each tension leveler on a continuous casting line (i=1 to n, n is the total number of tension levelers on the continuous casting line).

The arrow in the figure indicates the direction of the continuous casting process route, i.e., the advancing direction of the casting bloom.

Figure 3:
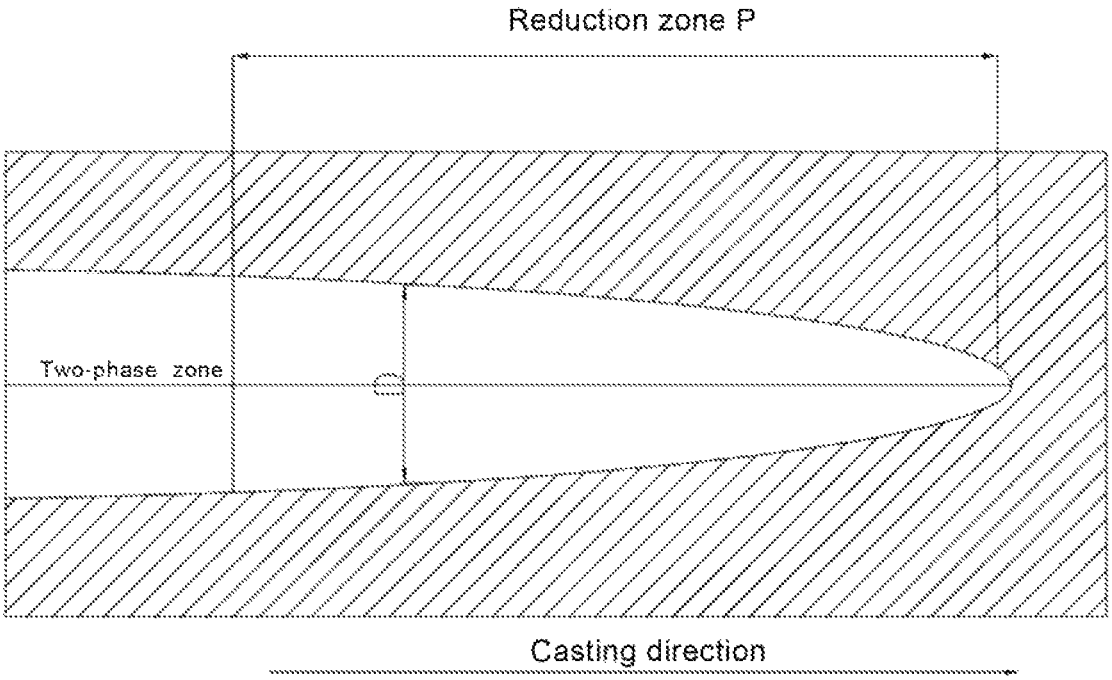
FIG. 3 shows schematically a width of a two-phase region at a solidification end of a bloom according to the present disclosure.

FIG. 3 shows the thicknesses of the two-phase region and the solid-phase region of the casting bloom.

The hatched portion in the figure shows the solid-phase region; the blank region shows the two-phase region; D is the width of the two-phase region; P is the reduction zone in which $f_s$=0.25 to 0.80; and the arrow indicates the direction of the continuous casting process route, i.e., the advancing direction of the casting bloom.

According to the calculation results in FIG. 3, the tension levelers far from the solidification end (that is, the upstream tension levelers whose number i is smaller, wherein the i value may be selected from 1-4) can meet the requirement of the corresponding part of the casting bloom for soft reduction, because the bloom shell is thin, the temperature of the casting bloom is high, and thus a smaller soft reduction force is needed. The tension levelers closer to the solidification end (that is, the downstream tension levelers whose number i is larger, wherein the i value may be selected from 5-8) cannot meet the requirement of the corresponding part of the casting bloom for soft reduction, because the bloom shell is thick, the temperature of the casting bloom is low, and thus a larger soft reduction force is needed.

Therefore, the technical solution of the present disclosure utilizes a soft reduction method combining a flat roll and a convex roll, wherein the upstream tension levelers still use a flat roll scheme, while the downstream tension levelers use a convex roll scheme. Especially for an existing continuous casting machine, due to the insufficient reduction ability of the downstream tension levelers, it is very suitable to adopt this combination scheme for soft reduction. The boundary between the upstream tension levelers and the downstream tension levelers is usually related with $f_s$. The inventors recommend that when the solid fraction of the casting bloom is $f_s \leq 0.5$, flat roll tension levelers are used to perform compression casting on the casting bloom; for solid fraction $f_s > 0.5$, convex roll tension levelers are used to perform compression casting on the casting bloom.

Figure 4:
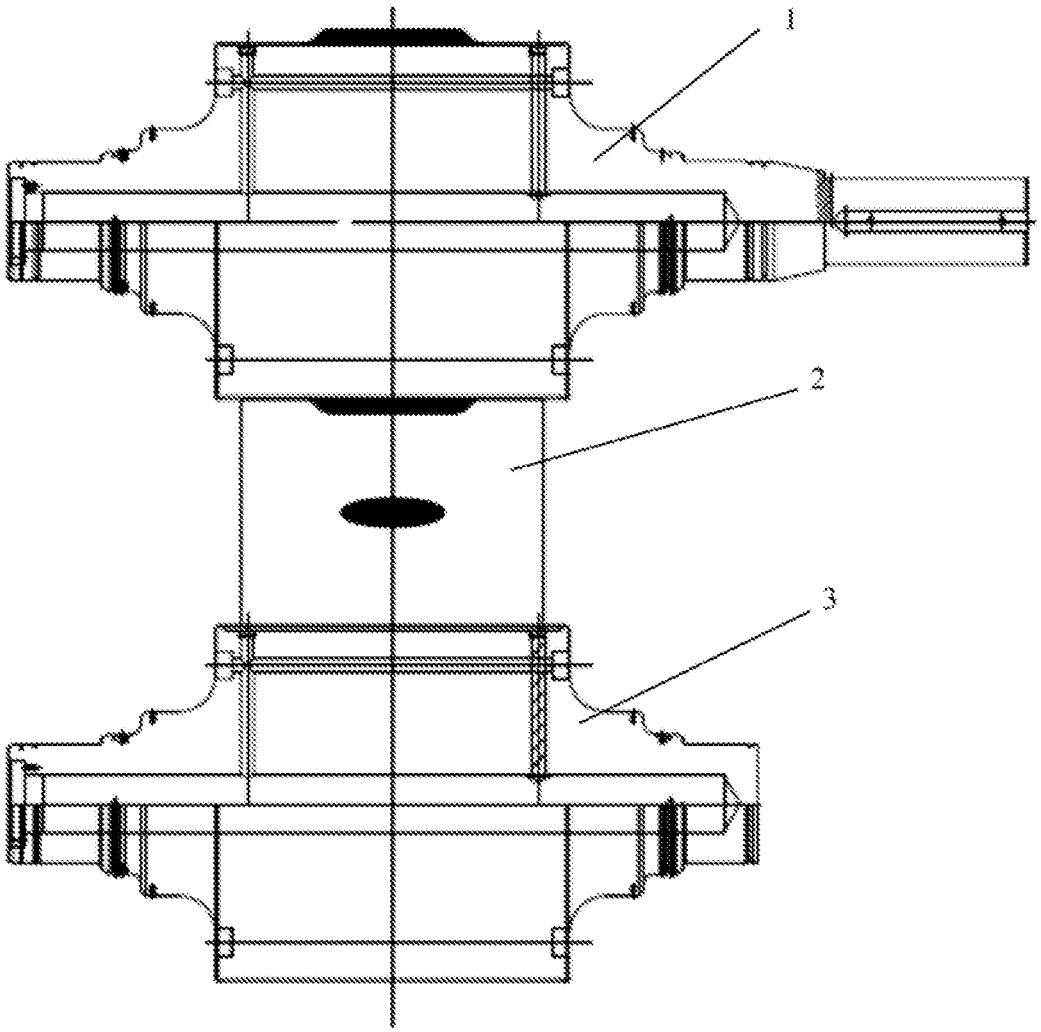
FIG. 4 shows schematically reduction of a bloom with a convex roll of a tension leveler according to the present disclosure.

FIG. 4 is a schematic view showing a convex roll tension leveler. The upper roll 1 is a convex roll which is a driving roll. It can be raised or lowered to adjust the roll gap, and is connected to a motor and a speed reducer. The lower roll 3 is a flat roll which is a fixed driven roll. The upper and lower rolls are connected by a frame, and a reduction force is applied to the casting bloom therebetween through four pairs of driving hydraulic cylinders.

The casting bloom 2 is located between the upper roll and the lower roll.

Figure 5:
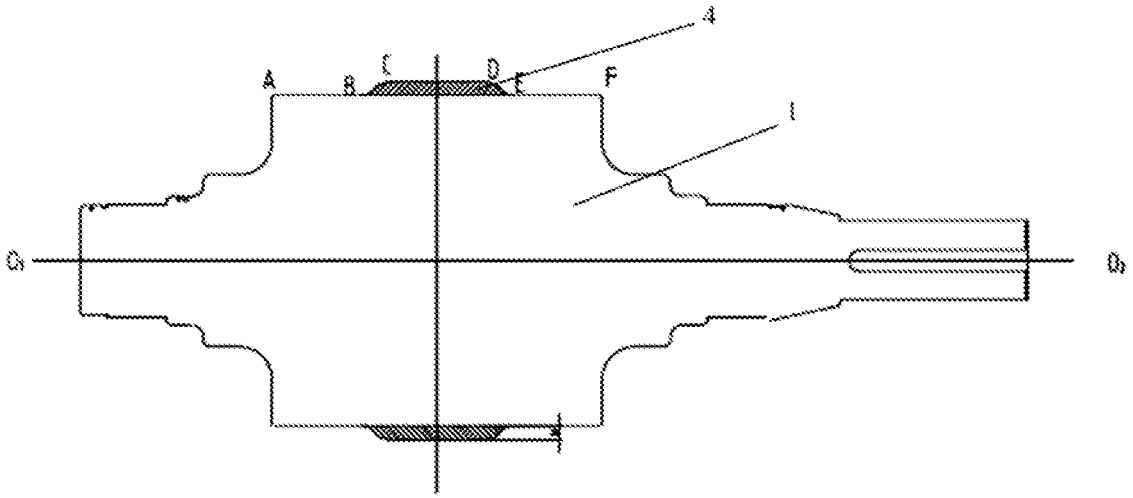
FIG. 5 shows schematically a profile of a convex roll.

FIG. 5 is a schematic structural view showing the profile of the convex roll of the convex roll tension leveler in the present technical solution. It can be seen from the figure that the profile curve of the working part of roll body of the convex shape roll (convex roll for short) consists of a first straight line section AB, a first transition curve section BC, a second straight line section CD, a second transition curve section DE, and a third straight line section EF.

The first transition curve section BC and the second transition curve section DE are each composed of a sine curve, or composed of two arc lines that are respectively tangent to adjacent straight line sections, one inwardly concave, and the other outwardly convex. The radii of the two arcs are equal or unequal.

Obviously, for the longitudinal section of each convex roll in the axial direction, the first transition curve section BC, the second straight line section CD and the second transition curve section DE form a protruding structure 4 in the form of a protuberance on the surface of the convex roll.

In the coordinate system of FIG. 5, point B is the origin of coordinates; the x-axis is parallel to the central axis of the roll; and the y-axis is perpendicular to the central axis of the roll.

The sine curve equation of the first transition curve section BC is:

$$y = H \sin(x * \pi / 2nH)$$

wherein H is the height of the protuberance. n is the projection length of the first transition curve section BC of the protuberance on the axis.

n is a multiple of the height H of the protuberance. That is, the projection length of the first transition curve section BC of the protuberance on the axis is nH.

The second transition curve DE can be formed as a mirror image of the first transition curve BC about a center line passing through the midpoint of the line section CD.

It's particularly noted that the length of the second straight line section CD in the middle of the convex roll body depends on the width D of the unsolidified two-phase region of the continuous casting bloom when it arrives at the position of each tension leveler in FIG. 3.

Because the width D of the unsolidified two-phase region varies as the casting bloom arrives at the positions of the various tension levelers, the lengths of the second straight line sections (also known as the middle straight line sections) CD of the various convex rolls are also different in accordance with the various positions of the tension levelers.

Theoretically, the length CDi of the second straight line section of the convex roll corresponding to each tension leveler (where i=the position number of each tension leveler on the continuous casting line) should be greater than or equal to the width Di of the unsolidified two-phase region when the casting bloom arrives at the position of each tension leveler (where i=the position number of each tension leveler on the continuous casting line). The Di value varies for different casting speeds, steel grades, superheat degrees, and cooling intensities. With versatility taken into account, for each tension leveler, the length of the second straight line section CDi of the corresponding convex roll should be greater than the width Di of the unsolidified two-phase region when the casting bloom arrives at the position of each tension leveler. Another consideration is that the casting bloom will deviate from the center line of the casting flow during the downward drawing of the bloom (referred to as a bias flow). A small bias flow does not have much impact on the flat roll tension leveler, because the flat roll can always compress the unsolidified two-phase region in the center of the casting bloom. However, it is required that the protruding part (that is, the aforementioned protuberance) of the convex roll can also compress the unsolidified two-phase region in the center of the casting bloom.

With an overall consideration, for each tension leveler i, the recommended length of the second straight line section CDi corresponding to the convex roll is ≥Di+40 mm (where i=the position number of each tension leveler on the continuous casting line).

The height H of the protuberance is determined according to the total shrinkage and the linear shrinkage of the solidified volume in the reduction zone for all tension levelers. With versatility taken into account, it is 30% larger than the theoretically calculated value.

Figure 6:
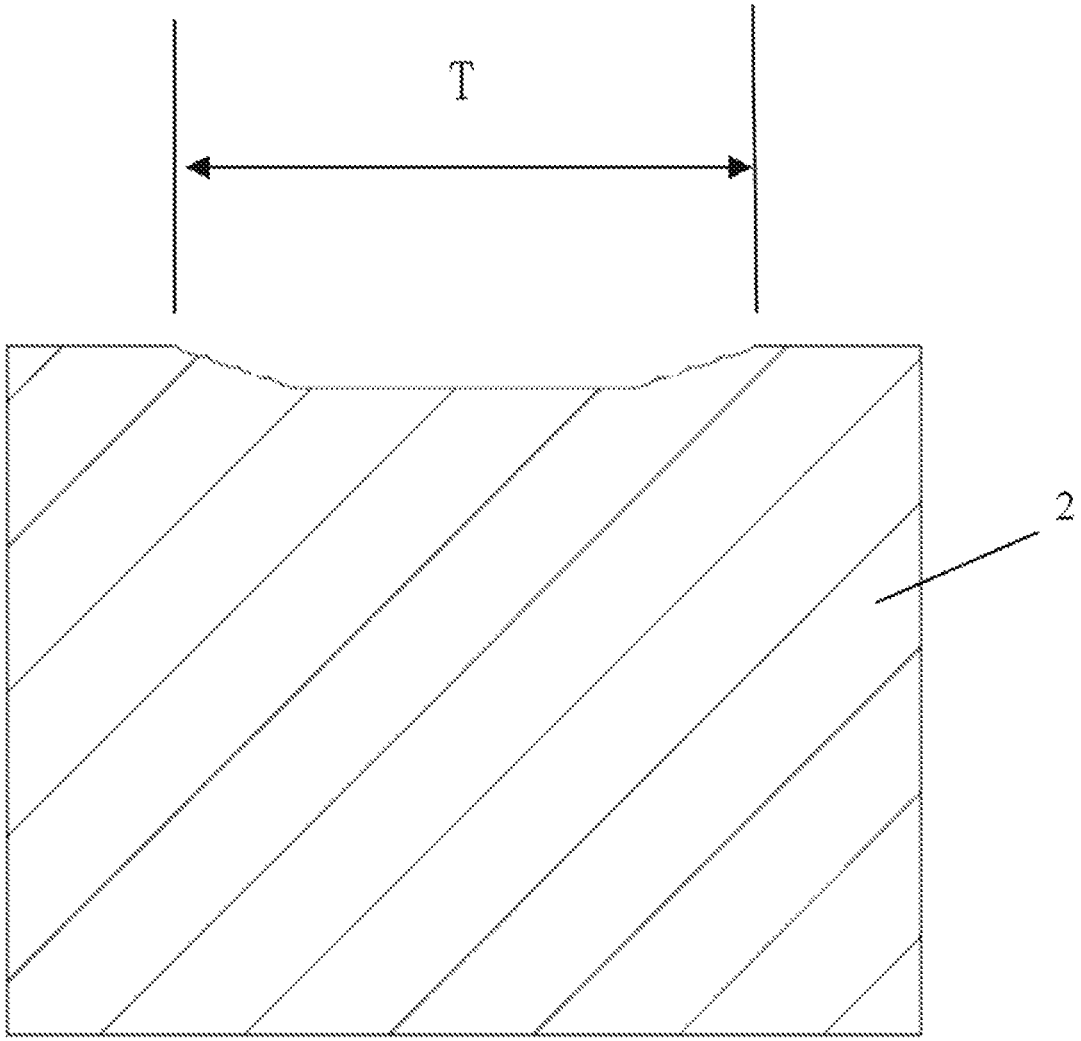
FIG. 6 shows schematically an indentation profile on an upper surface of a cast bloom.

FIG. 6 shows the profile of the indentation generated on the upper surface of the final casted bloom after the end of the soft reduction using reduction rolls having protuberances of different lengths.

Obviously, the opening of the indentation T is widened (more accurately, it shows a trend of gradual widening from the bottom of the opening upward, and it's approximately an inverted antiparallelogram). This can avoid occurrence of folding defects in a subsequent steel rolling process, and it is more conducive to reducing the reduction force of the convex roll tension leveler.

According to the technical solution of the present disclosure, the soft reduction method for a continuous casting bloom with a combination of a flat roll and a convex roll is used to control the soft reduction at the solidification end, and it is used comprehensively to reduce center porosity, shrinkage cavity and segregation of the cast bloom, and improve the internal quality of a rolled material.

Large volume shrinkage of a casting bloom will occur during solidification of the casting bloom, so a larger reduction is needed to compensate for the volume shrinkage of the casting bloom. During the reduction process, deformation resistance will be introduced in the casting bloom, and it will be mainly concentrated in the solidified shells on both sides.

The soft reduction method for a continuous casting bloom with a combination of a flat roll and a convex roll according to the present disclosure prevents the large deformation resistance of the solidified shells on both sides, and the reduction force of the convex roll tension leveler may be reduced. When $f_s$=0.9-1.0, heavy reduction can be applied to the solidification end of the casting bloom to increase the density of the center of the casting bloom. At the same time, due to the small contact area between the convex roll and the casting bloom, the friction is reduced, so the withdrawal resistance is also reduced in the continuous casting process of the casting bloom.

At the same time, in the soft reduction method for a continuous casting bloom with a combination of a flat roll and a convex roll according to the present disclosure, instead of fulfilling the soft reduction by applying a large reduction amount with a single convex roll, the reduction is dispersed. After the reduction is completed, the reduction rolls with protuberances of different lengths provide a wider opening to the indentation profile generated on the upper surface of the cast bloom at the end. This can avoid occurrence of folding defects in a subsequent steel rolling process, and it is more conducive to reducing the reduction force of the convex roll tension leveler.

EXAMPLES

Example 1

9 tension levelers were disposed sequentially in the advancing direction of the continuous casting process line, and the serial numbers of the tension levelers were No. 1 to No. 9.

First of all, model calculation was performed on the solidification heat transfer and liquid phase cavity in the continuous casting of a bloom according to the theories of continuous casting and casting molding. A three-dimensional temperature field profile, a two-phase region thickness, a solid-phase region thickness and a solid fraction were calculated from various steel grades, drawing speeds, cooling conditions, and superheat degrees when the casting bloom arrived at a position corresponding to each tension leveler. Then, based on the model calculation, positions of rolls starting and ending reduction were determined, and associated with each tension leveler on the continuous casting line. The results are as follows:

Tension levelers Nos. 1-5 were equipped with flat rolls. The working body of the roll had a length of 500 mm, and a roll diameter of 500 mm.

Tension leveler No. 6 had a convex roll. The working body of this roll had a length of 500 mm, and a roll diameter of 500 mm. The height of the protuberance was H=20 mm. The straight line sections at both ends (i.e. the first and third straight line sections mentioned above, the same below) had a length of AB=EF=90 mm. The middle straight line section (i.e. the second straight line section mentioned above, the same below) CD had a length of 240 mm. The projection length of the transition curves BC and DE (i.e. the first transition curve BC and the second transition curve DE mentioned above, the same below) in the horizontal direction was 40 mm.

Tension leveler No. 7 had a convex roll. The working body of this roll had a length of 500 mm, and a roll diameter of 500 mm. The height of the protuberance was H=20 mm. The straight line sections at both ends had a length of AB=EF=105 mm. The middle straight line section CD had a length of 210 mm. The projection length of the transition curves BC and DE in the horizontal direction was 40 mm.

Tension leveler No. 8 had a convex roll. The working body of this roll had a length of 500 mm, and a roll diameter of 500 mm. The height of the protuberance was H=20 mm. The straight line sections at both ends had a length of AB=EF=120 mm. The middle straight line section CD had a length of 180 mm. The projection length of the transition curves BC and DE in the horizontal direction was 40 mm.

Tension leveler No. 9 had a convex roll. The working body of this roll had a length of 500 mm, and a roll diameter of 500 mm. The height of the protuberance was H=20 mm. The straight line sections at both ends had a length of AB=EF=135 mm. The middle straight line section CD had a length of 150 mm. The projection length of the transition curves BC and DE in the horizontal direction was 40 mm.

Example 2

Tension levelers Nos. 1-5 were equipped with flat rolls. The working body of the roll had a length of 500 mm, and a roll diameter of 500 mm.

Tension leveler No. 6 had a convex roll. The working body of this roll had a length of 500 mm, and a roll diameter of 500 mm. The height of the protuberance was H=20 mm. The straight line sections at both ends had a length of AB=EF=85 mm. The middle straight line section CD had a length of 250 mm. The projection length of the transition curves BC and DE in the horizontal direction was 40 mm.

Tension leveler No. 7 had a convex roll. The working body of this roll had a length of 500 mm, and a roll diameter of 500 mm. The height of the protuberance was H=20 mm. The straight line sections at both ends had a length of AB=EF=95 mm. The middle straight line section CD had a length of 230 mm. The projection length of the transition curves BC and DE in the horizontal direction was 40 mm.

Tension leveler No. 8 had a convex roll. The working body of this roll had a length of 500 mm, and a roll diameter of 500 mm. The height of the protuberance was H=20 mm. The straight line sections at both ends had a length of AB=EF=105 mm. The middle straight line section CD had a length of 210 mm. The projection length of the transition curves BC and DE in the horizontal direction was 40 mm.

Tension leveler No. 9 had a convex roll. The working body of this roll had a length of 500 mm, and a roll diameter of 500 mm. The height of the protuberance was H=20 mm. The straight line sections at both ends had a length of AB=EF=115 mm. The middle straight line section CD had a length of 190 mm. The projection length of the transition curves BC and DE in the horizontal direction was 40 mm.

The rest was the same as Example 1.

Example 3

Tension levelers Nos. 1-5 were equipped with flat rolls. The working body of the roll had a length of 500 mm, and a roll diameter of 500 mm.

Tension leveler No. 6 had a convex roll. The working body of this roll had a length of 500 mm, and a roll diameter of 500 mm. The height of the protuberance was H=20 mm. The straight line sections at both ends had a length of AB=EF=90 mm. The middle straight line section CD had a length of 240 mm. The projection length of the transition curves BC and DE in the horizontal direction was 40 mm.

Tension leveler No. 7 had a convex roll. The working body of this roll had a length of 500 mm, and a roll diameter of 500 mm. The height of the protuberance was H=20 mm. The straight line sections at both ends had a length of AB=EF=105 mm. The middle straight line section CD had a length of 210 mm. The projection length of the transition curves BC and DE in the horizontal direction was 40 mm.

Tension leveler No. 8 had a convex roll. The working body of this roll had a length of 500 mm, and a roll diameter of 500 mm. The height of the protuberance was H=20 mm. The straight line sections at both ends had a length of AB=EF=120 mm. The middle straight line section CD had a length of 180 mm. The projection length of the transition curves BC and DE in the horizontal direction was 40 mm.

Tension levelers No. 9 was equipped with flat rolls. The working body of the roll had a length of 500 mm, and a roll diameter of 500 mm.

The rest was the same as Example 1.

Example 4

Tension levelers Nos. 1-4 were equipped with flat rolls. The working body of the roll had a length of 500 mm, and a roll diameter of 500 mm.

Tension leveler No. 5 had a convex roll. The working body of this roll had a length of 500 mm, and a roll diameter of 500 mm. The height of the protuberance was H=20 mm. The straight line sections at both ends had a length of AB=EF=85 mm. The middle straight line section CD had a length of 250 mm. The projection length of the transition curves BC and DE in the horizontal direction was 40 mm.

Tension leveler No. 6 had a convex roll. The working body of this roll had a length of 500 mm, and a roll diameter of 500 mm. The height of the protuberance was H=20 mm. The straight line sections at both ends had a length of AB=EF=95 mm. The middle straight line section CD had a length of 230 mm. The projection length of the transition curves BC and DE in the horizontal direction was 40 mm.

Tension leveler No. 7 had a convex roll. The working body of this roll had a length of 500 mm, and a roll diameter of 500 mm. The height of the protuberance was H=20 mm. The straight line sections at both ends had a length of AB=EF=105 mm. The middle straight line section CD had a length of 210 mm. The projection length of the transition curves BC and DE in the horizontal direction was 40 mm.

Tension leveler No. 8 had a convex roll. The working body of this roll had a length of 500 mm, and a roll diameter of 500 mm. The height of the protuberance was H=20 mm. The straight line sections at both ends had a length of AB=EF=115 mm. The middle straight line section CD had a length of 190 mm. The projection length of the transition curves BC and DE in the horizontal direction was 40 mm.

Tension levelers No. 9 was equipped with flat rolls. The working body of the roll had a length of 500 mm, and a roll diameter of 500 mm.

The rest was the same as Example 1.

In summary, when the present disclosure is implemented, first of all, a three-dimensional temperature field profile, a two-phase region thickness, a solid-phase region thickness and a solid fraction $f_s$ when the casting bloom arrives at the position of each tension leveler are calculated from various steel grades, drawing speeds, cooling conditions, and superheat degrees. The soft reduction zone starts from $f_s$=0.25 and ends at $f_s$=0.80. The positions of rolls starting and ending reduction are determined based on the model calculation. The reduction of each roll is determined according to the volume shrinkage. When the casting bloom enters the reduction zone, the reduction of a single roll is not greater than 5 mm. When $f_s$=0.9-1.0, the maximum reduction of a single roll may be 10 mm.

Due to the use of a soft reduction method for a continuous casting bloom with a combination of a flat roll and a convex roll in the technical solution of the present disclosure, the solidified bloom shells on both sides are prevented from generating large deformation resistance, which can reduce the reduction force of the convex roll tension leveler. When $f_s$=0.9-1.0, heavy reduction can be applied to the solidification end of the casting bloom to increase the density of the center of the casting bloom. At the same time, due to the small contact area between the convex roll and the casting bloom, the friction is reduced, so the withdrawal resistance is also reduced in the continuous casting process of the casting bloom.

The disclosure can be widely applied in the field of metal casting.

What is claimed is:

1. A soft reduction method for a continuous casting bloom with a combination of a flat roll and a convex roll, comprising sequentially arranging a plurality of tension levelers on a continuous casting line to compression cast a casting bloom, characterized by:

acquiring model data of solidification heat transfer and liquid phase cavity in continuous casting of the casting bloom according to steel grades, drawing speeds, cooling conditions, and superheat degrees for casting molding, wherein the model data include a three-dimensional temperature field profile, a two-phase region thickness, a solid-phase region thickness and a solid fraction $f_s$ along a casting direction;

determining positions of rolls starting and ending reduction based on the model data, and associating the model data with each tension leveler on the continuous casting line;

acquiring a volume shrinkage of the casting bloom, setting a reduction for each tension leveler roll based on the volume shrinkage, and implementing a heavy reduction operation mode on the casting bloom in a zone of the casting bloom having a solid fraction of $f_s$=0.9 to 1.0, wherein the corresponding tension levelers each achieve a reduction with a single-roll reduction rate of 1%-10%;

implementing a soft reduction operation mode on the casting bloom in a zone of the casting bloom having a solid fraction of $f_s$=0.25 to 0.80, wherein the corresponding tension levelers each achieve a reduction with a single-roll reduction rate of no more than 2%;

wherein the plurality of tension levelers are grouped into upstream tension levelers and downstream tension levelers, wherein the downstream tension levelers are closer to a solidification end of the casting bloom than the upstream tension levelers, wherein the downstream tension levelers are convex roll tension levelers, and the upstream tension levelers are flat roll tension levelers.

2. The soft reduction method for a continuous casting bloom with a combination of a flat roll and a convex roll according to claim 1, wherein when the solid fraction is $f_s \leq 0.5$, the flat roll tension leveler is used to perform compression casting on the casting bloom; and when the solid fraction is $f_s>0.5$, the convex roll tension leveler is used to perform compression casting on the casting bloom.

3. The soft reduction method for a continuous casting bloom with a combination of a flat roll and a convex roll according to claim 1, wherein an upper roll of the convex roll tension leveler is a convex roll which can be raised or lowered to adjust the roll gap, and the convex roll is connected to a motor and a speed reducer;

a lower roll of the convex roll tension leveler is a flat roll;

the upper roll and the lower roll are connected by a frame, and a reduction force is applied to the casting bloom therebetween through four pairs of driving hydraulic cylinders.

4. The soft reduction method for a continuous casting bloom with a combination of a flat roll and a convex roll according to claim 3, wherein the upper roll is a convex roll, and it is a driving roll.

5. The soft reduction method for a continuous casting bloom with a combination of a flat roll and a convex roll according to claim 3, wherein the lower roll is a flat roll, and it is a fixed driven roll.

6. The soft reduction method for a continuous casting bloom with a combination of a flat roll and a convex roll according to claim 3, wherein a working part of a body of the convex roll has a profile curve consisting of a first straight line section (AB), a first transition curve section (BC), a second straight line section (CD), a second transition curve section (DE), and a third straight line section (EF) connected in sequence, wherein the first straight line section (AB) and the third straight line section (EF) are arranged coaxially or coplanarly; the second straight line section (CD) and the first straight line section (AB) or the third straight line section (EF) are arranged in parallel;

wherein the first transition curve section (BC) and the second transition curve section (DE) are each composed of a sine curve, or composed of two arc lines, one inwardly concave, and the other outwardly convex, wherein the two arcs have equal or unequal radii;

wherein for a longitudinal section of the convex roll in an axial direction, the first transition curve section (BC), the second straight line section (CD) and the second transition curve section (DE) form a protruding structure in the form of a protuberance on a surface of the convex roll.

7. The soft reduction method for a continuous casting bloom with a combination of a flat roll and a convex roll according to claim 6, wherein when the first transition curve section (BC) of the protuberance is a sine curve, the sine curve has an equation:

$$y=H\sin(x*\pi/2nH);$$

wherein H is a height of the protuberance; n is a projection length of the first transition curve section (BC) of the protuberance on the axis x.

8. The soft reduction method for a continuous casting bloom with a combination of a flat roll and a convex roll according to claim 6, wherein the second transition curve (DE) is mirror-symmetrical to the first transition curve (BC), and a mirror-symmetrical centerline is a straight line that passes through a midpoint of the second straight line section (CD) and is perpendicular to the second straight line section (CD).

9. The soft reduction method for a continuous casting bloom with a combination of a flat roll and a convex roll according to claim 6, wherein in the zone where the casting bloom has a solid fraction $f_s$=0.25 to 0.80, for each tension leveler, an opening of an indentation profile generated on an upper surface of the casting bloom is equal to a length of the second straight line section (CD) of the body of the convex roll.

10. The soft reduction method for a continuous casting bloom with a combination of a flat roll and a convex roll according to claim 6, wherein a length of the second straight line section (CD) of the body of the convex roll of each tension leveler depends on a width (D) of the unsolidified two-phase region of the casting bloom when it arrives at a position corresponding to each tension leveler.

11. The soft reduction method for a continuous casting bloom with a combination of a flat roll and a convex roll according to claim 10, wherein the length of the second straight line section (CD) of the body of the convex roll of each tension leveler is ≥D+40 mm.

12. The soft reduction method for a continuous casting bloom with a combination of a flat roll and a convex roll according to claim 1, wherein the model data are acquired by performing model calculation on the solidification heat transfer and liquid phase cavity in the continuous casting of the bloom according to theories of continuous casting and casting molding, wherein the three-dimensional temperature field profile, the two-phase region thickness, the solid-phase region thickness and the solid fraction $f_s$ are calculated from various steel grades, drawing speeds, cooling conditions, and superheat degrees when the casting bloom arrives at a position corresponding to each tension leveler.

13. The soft reduction method for a continuous casting bloom with a combination of a flat roll and a convex roll according to claim 1, wherein a maximum single-roll reduction is 10 mm for each of the tension levelers implementing a heavy reduction operation mode on the casting bloom; and a single-roll reduction is no more than 5 mm for each of the tension levelers implementing a soft reduction operation mode on the casting bloom.

* * * * *